United States Patent [19]

McClaflin

[11] 4,355,651

[45] Oct. 26, 1982

[54] METHOD OF TRANSPORTING VISCOUS HYDROCARBONS

[75] Inventor: Gifford G. McClaflin, Ponca City, Okla.

[73] Assignee: Conoco Inc., Ponca City, Okla.

[21] Appl. No.: 292,389

[22] Filed: Aug. 13, 1981

Related U.S. Application Data

[63] Continuation-in-part of Ser. No. 150,468, May 16, 1980, abandoned.

[51] Int. Cl.[3] ..... F17D 1/17

[52] U.S. Cl. ..... 137/13; 252/8.55 R; 252/312

[58] Field of Search ..... 252/8.3, 8.55 R, DIG. 17; 137/13

[56] References Cited

U.S. PATENT DOCUMENTS

| | | | |
|---|---|---|---|
| 3,004,056 | 10/1961 | Nunn et al. | 260/980 |
| 3,380,531 | 4/1968 | McAuliffe et al. | 137/13 X |
| 3,467,195 | 5/1969 | McAuliffe et al. | 252/8.55 X |
| 3,491,835 | 1/1970 | Gagle | 137/13 X |
| 4,108,193 | 8/1978 | Flournoy | 252/8.55 X |
| 4,265,264 | 5/1981 | Sifferman | 137/13 |

*Primary Examiner*—Herbert B. Guynn
*Attorney, Agent, or Firm*—Robin M. Dowling

[57] ABSTRACT

An improvement in the method of transporting viscous hydrocarbons through pipes is disclosed. Briefly, the improvement comprises adding water containing an effective amount of a phosphate ester of a specific block copolymer. The resulting emulsion has a lower viscosity and is more easily transported.

9 Claims, No Drawings

METHOD OF TRANSPORTING VISCOUS HYDROCARBONS

CROSS-REFERENCE TO RELATED APPLICATIONS

The present application is a continuation-in-part of application Ser. No. 150,468, filed May 16, 1980, now abandoned.

FIELD OF THE INVENTION

The invention is in the general field of improved methods of pumping viscous hydrocarbons through a pipe, such as a well-bore or a pipeline.

GENERAL BACKGROUND

The movement of heavy crudes through pipes is difficult because of their high viscosity and resulting low mobility. One method of improving the movement of these heavy crudes has included adding to the crude lighter hydrocarbons (e.g. kerosine distillate). This reduces the viscosity and thereby improves the mobility. This method has the disadvantage that it is expensive and the kerosine distillate is becoming difficult to obtain.

Another method of improving the movement of these heavy crudes is by heating them. This requires the installation of expensive heating equipment and thus is an expensive process.

Still another method of moving heavy crudes through pipes uses oil-in-water emulsions which was surfactants to form the emulsions.

U.S. Pat. No. 3,943,954 teaches a method of moving viscous hydrocarbons through a pipe wherein the method uses a solution containing an anionic surfactant or soap such as sodium tridecyl sulfate or sodium oleate together with a guanidine salt and optionally with an alkalinity agent and/or a nonionic surfactant such as polyethoxylated alcohols.

To my knowledge there is no teaching that a phosphate ester of a specific block copolymer is effective in reducing the viscosity of viscous hydrocarbons. I have found that these materials are effective for this use. Surprisingly, I have found that the composition of the block copolymers influences the effectiveness of the phosphate ester derived therefrom in reducing the viscosity of a viscous hydrocarbon.

BRIEF SUMMARY OF THE INVENTION

Briefly stated, the present invention is directed to an improvement in the method of pumping a viscous hydrocarbon through a pipe wherein the improvement comprises forming an oil-in-water emulsion by adding to said hydrocarbon from about 20 to about 80 volume percent water containing an effective amount of a phosphate ester of a block copolymer which is represented by the formula

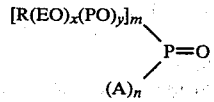

wherein

R is $C_2$ to $C_{30}$ alkyl group,
EO is an ethylene oxide unit,
PO is a propylene oxide unit, x is a number in the range of about 2 to about 7,
y is a number in the range of about 2 to about 5,
A=OH,
m is an integer of 1 to 3,
n is an integer of 0 to 2 with the sum of m+n being 3.

In one embodiment, the invention is directed to a method, as described in the foregoing, wherein the water contains above 500 parts per million of hardness cations.

DETAILED DESCRIPTION

Insofar as is known my method is suitable for use with any viscous crude oil. It is well known that crude oils often contain a minor amount of water.

The amount of water which is added to the hydrocarbon is suitably in the range of about 20 to about 80 volume percent based on the hydrocarbon. A preferred amount of water is in the range of about 30 to 60 volume percent. The water can be pure or can have a relatively high amount of dissolved solids. Any water normally found in the proximity of a producing oil-well is suitable.

The phosphate ester of my invention is effective in water containing relatively large amounts of "hardness" cations. For example, the phosphate ester can be used in water containing above 500 parts per million or even above 2,000 parts per million of hardness cations. The term "hardness cations" refers to magnesium, calcium, strontium and barium.

The phosphate esters of a block copolymer which are suitable for use in my invention can be represented by the formula

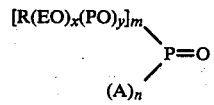

wherein

R is a $C_2$ to $C_{30}$, preferably $C_{10}$ to $C_{20}$, alkyl group,
EO is an ethylene oxide unit, i.e. $CH_2CH_2O$,
PO is a propylene oxide unit, i.e. $CH(CH_3)CH_2O$,
x is a number in the range of about 2 to about 7, preferably about 3 to about 6, and
y is a number in the range of about 2 to about 5, preferably about 3 to about 4,
A=OH,
m is an integer of 1 to 3,
n is an integer of 0 to 2 with the sum of m+n being 3.

Suitable and preferred amounts of the phosphate ester of block copolymers, based on the hydrocarbon, are shown below.

| | (parts per million) Suitable | Preferred |
|---|---|---|
| Phosphate ester of block polymers | 100–5,000 | 500–2,500 |

In order to disclose the nature of the present invention still more clearly, the following examples, both illustrative and comparative, will be given. It is to be understood, however, that the invention is not to be limited to the specific conditions or details set forth in these examples except insofar as such limitations are specified in the appended claims.

The following materials were used in the tests described herein:

Crude Oil—Goodwin lease crude from Cat Canyon oil field, Santa Maria, Calif. (Examples 1–4)

Water—Goodwin synthetic (Water prepared in laboratory to simulate water produced at the well. It contained 4720 ppm total solids and 25 ppm of hardness cations.) (Examples 1–4)

The phosphate ester of block copolymer which illustrates the invention had the following composition:

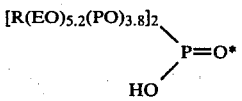

*While there is a slight difference in the formulae shown for the materials tested, as compared to the formulae shown in the parent application, it should be emphasized that the same materials were tested in this and the parent application.

wherein R was a $C_{13}$ alkyl group.

For purposes of comparison a phosphate ester of block copolymer having the following composition was tested:

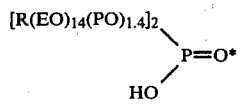

*While there is a slight difference in the formulae shown for the materials tested, as compared to the formulae shown in the parent application, it should be emphasized that the same materials were tested in this and the parent application.

wherein R was a $C_{13}$ alkyl group.

Viscosities were determined using a Brookfield viscometer, Model LVT with No. 3 spindle. The procedure is described below.

Test Procedure

Three hundred ml of crude oil, preheated in a large container to about 93° C. in a laboratory oven, was transferred to a Waring blender and stirred at medium speed until homogeneous. Stirring was stopped, temperature recorded, and the viscosity measured using the Brookfield viscometer at RPM's (revolutions per minute) of 6, 12, 30 and 60. Viscosity was calculated by using a multiplication factor of 200, 100, 40 and 20 for the respective speeds times the dial reading on the viscometer.

It may be well to mention that the final result at 6 RPM is an indication of the stability of the solution being tested.

EXAMPLES 1 AND 2

Examples 1 and 2 used 300 ml crude oil plus 300 ml Goodwin synthetic water containing 2,500 parts per million of the phosphate ester wherein x and y were 5.2 and 3.8, respectively. The viscosity values on the crude oil alone are shown also.

| RPM | Crude Oil | | Viscosity, cp Example 1 | Example 2 |
|---|---|---|---|---|
| 6 | 3,000 | 2,940 | 40 | 40 |
| 12 | 2,850 | 2,740 | 50 | 30 |
| 30 | 2,680 | 2,580 | 52 | 32 |
| 60 | Offscale | Offscale | 44 | 24 |
| 30 | 2,560 | 2,536 | 72 | 24 |
| 12 | 2,550 | 2,650 | 130 | 30 |
| 6 | 2,520 | 2,680 | 160 | 60 |
| Test Temp., °C. | 87 | 87 | 83 | 81 |

EXAMPLES 3 AND 4

These examples are comparative in that they used the phosphate ester wherein x and y were 14 and 1.4, respectively. They used 300 ml crude oil plus 300 ml Goodwin synthetic water containing 2,500 parts per million of the phosphate ester. The viscosity values are shown below.

| RPM | Viscosity, cp Example 3 | Example 4 |
|---|---|---|
| 6 | 40 | 80 |
| 12 | 350 | 280 |
| 30 | 920 | 280 |
| 60 | 660 | 220 |
| 30 | 1,380 | 640 |
| 12 | 2,630 | 2,000 |
| 6 | 3,800 | 3,800 |
| Test Temp., °C. | 81 | 81 |

EXAMPLES 5 AND 6

These examples are both illustrative and comparative in that they show that the material of Examples 1 and 2 were satisfactory while the material of Examples 3 and 4 were not satisfactory.

A Butterly crude oil was used. This crude oil was from the Butterly lease in Garvin County, Okla. Typically, the crude oil has a viscosity of about 10,000 cp. at 20° C.

The water was a Butterly produced water which typically has the following properties: Total solids—about 46,000 parts per million; Total hardness cations—about 2,100 parts per million.

Example 5—300 ml crude plus 300 ml water containing 1,000 parts per million phosphate ester wherein x and y equals 14 and 1.4, respectively.

Example 6—300 ml crude plus 300 ml water containing 1,000 parts per million phosphate ester wherein x and y equals 5.2 and 3.8 respectively.

The results are shown below.

| RPM | Crude Oil | Viscosity, cp Example 5 | Example 6 |
|---|---|---|---|
| 6 | 3,060 | 8,100 | 400 |
| 12 | 3,070 | 9,000 | 850 |
| 30 | 3,120 | Offscale | 1,320 |
| 60 | Offscale | Offscale | 1,226 |
| Test Temp., °C. | 27 | 21 | 21 |

EXAMPLE 7

This example is illustrative and shows the results obtained using the phosphate ester of Examples 1 and 2 (x and y equals 5.2 and 3.8, respectively) in a water having a hardness of about 720.

A Loco crude oil was used. This crude oil was from the Loco lease, Stephens County, Okla. Typically, the crude oil has a viscosity of about 350 cp. at 21° C.

The water was a Loco produced water which typically has the following properties: Total solids—about 12,000 parts per million; Total hardness cations—about 720 parts per million.

The viscosity properties of tests on the following are shown below.

A—Crude Oil Alone

B—50/50 Crude Oil—Water Mixture

C—50/50 Crude Oil—Water containing 500 parts per million phosphate ester

| RPM | Viscosity, cp A | B | C |
|---|---|---|---|
| 6 | 30 | 45 | 50 |
| 12 | 334 | 435 | 62.5 |
| 30 | O.S. | O.S. | 65 |
| 60 | O.S. | O.S. | 64.5 |
| 30 | O.S. | O.S. | 97 |
| 12 | 345 | 425 | 155 |
| 6 | 340 | 440 | 230 |
| Test Temp., °C. | 21 | 21 | 21 |

O.S. = Offscale

Thus, having described the invention in detail, it will be understood by those skilled in the art that certain variations and modifications may be made without departing from the spirit and scope of the invention as defined herein and in the appended claims.

I claim:

1. In the method of pumping a viscous hydrocarbon through a pipe the improvement which comprises forming an oil-in-water emulsion by adding to said hydrocarbon from about 20 to about 80 volume percent of an aqueous solution containing an effective amount, in the range of about 100 to about 5,000 parts per million, based on said hydrocarbon, of a phosphate ester of a block copolymer which is represented by the formula

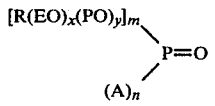

wherein

R is a $C_2$ to $C_{30}$ alkyl group,

EO is an ethylene oxide unit,

PO is a propylene oxide unit, x is a number in the range of about 2 to about 7, y is a number in the range of about 2 to about 5,

A=OH, m is an integer of 1 to 3 n is an integer of 0 to 2 with the sum of m+n being 3

2. The method of claim 1 wherein x is a number in the range of about 3 to about 5, y is a number in the range of about 3 to about 4 and R is an alkyl group containing about 10 to about 20 carbon atoms.

3. The method of claim 2 wherein the hydrocarbon is a crude oil.

4. The method of claims 1, 2 or 3 wherein the aqueous solution contains above 500 parts per million of hardness cations.

5. The method of claim 1 wherein the amount of aqueous solution, added to said hydrocarbon, is about 30 to about 60 volume percent.

6. The method of claim 5 wherein x is a number in the range of about 3 to about 5, y is a number in the range of about 3 to about 4, R is an alkyl group containing about 10 to about 20 carbon atoms, m is 2 and n is 1.

7. The method of claim 6 wherein the hydrocarbon is a crude oil.

8. The method of claim 7 wherein x is 5.2 and y is 3.8.

9. The method of claims 5, 6, 7, or 8 wherein the aqueous solution contains above 2,000 parts per million of hardness cations.

* * * * *